US007032528B2

(12) United States Patent
Amy

(10) Patent No.: US 7,032,528 B2
(45) Date of Patent: Apr. 25, 2006

(54) CLEAT WITH GASKET

(76) Inventor: Ron Amy, P.O. Box 263, Penngrove, CA (US) 94951

( * ) Notice: Subject to any disclaimer, the term of this patent is extended or adjusted under 35 U.S.C. 154(b) by 288 days.

(21) Appl. No.: 10/689,377

(22) Filed: Oct. 20, 2003

(65) Prior Publication Data

US 2005/0081773 A1 Apr. 21, 2005

(51) Int. Cl.
*B63B 21/04* (2006.01)

(52) U.S. Cl. ..... 114/218
(58) Field of Classification Search ..... 114/218
See application file for complete search history.

(56) References Cited

U.S. PATENT DOCUMENTS 3,126,859 A * 3/1964 Bigelow ..... 114/218

* cited by examiner

*Primary Examiner*—Ed Swinehart
(74) *Attorney, Agent, or Firm*—Johnson & Stainbrook, LLP; Craig M. Stainbrook; Larry D. Johnson

(57) ABSTRACT

Cleat with gasket comprising a rigid horizontally disposed elongate bar and a plurality of vertically disposed support members. The upper portion of the support member is attached to the bar. The mid portion of the support structure poses a horizontally disposed flat plate, the underside of which is recessed to receive a resilient gasket. A threaded post extends down from the underside of the recess so that it can penetrate the deck of a boat. The gasket protrudes slightly from the recessed area and is compressed in a controlled way when a nut on the treaded post is tightened forcing the flat plate down onto the deck of a boat thereby eliminating the chance of leakage through the deck.

7 Claims, 7 Drawing Sheets

CLEAT WITH GASKET

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of vessel cleats and more specifically to a vessel cleat with recessed gasket.

Vessels such as sail boats, power boats and the like need to be restrained from drifting away from a dock when stationed at a port or the like. To this end, rope cleats are mounted to the perimeter of the deck of a standard vessel so that the boat owner can attach a rope from the dock to the vessel thereby restraining the vessel from leaving the dock.

Cleats are commonly bolted to the deck of a vessel. Conventional cleats have an elongate bar that is held up a few inches by a plurality of support structures. Each support structure has a female aperture that can accept a standard bolt or has a threaded post cast into the underside of the support structure. Each stud penetrates an aligned aperture in the deck of the vessel and a mating nut is attached to the threaded studs from the underside of the deck thereby securing the cleat to the deck. Other items, including antenna mounts and deck fill caps such as used for gas and water fill and waste removal, also are commonly secured to a deck in a similar way.

The space between the deck and the flat bottom of the cleat support structure is generally filled with a caulking material or a flexible washer such as rubber or the like. Unfortunately, the act of tightening the nut forces the flat underside of the support structure toward the surface of the deck thereby causing any caulking material to be squeezed out or any rubber washer to be distorted and thereby not properly sealed around the stud. Additionally, the harsh environment found in the boating world including great temperature changes, humidity changes and corrosive salt water environments can cause the caulking or the rubber washer between the cleat support structure and the deck to degrade thereby causing a potential pathway for water to travel. When the caulking deteriorates or when the edges of an exposed gasket break down, water can penetrate to the threaded post and travel down the post's sides to the underside of the deck. The resulting water damage can require expensive and time consuming repairs. Furthermore, if the cleat support structures are resting on a compressible gasket material such as rubber or the like, unwanted movement occurs from side loads as dock lines pull on the cleat. A further complication in using a compressible gasket is that there is an increase of flex loads on the threaded stud fasteners and attached nuts that could result in mechanical failure causing the cleat to break away from the deck and the moored boat to drift away from its mooring.

BRIEF SUMMARY OF THE INVENTION

The primary object of the invention is to provide a rope cleat for a vessel deck that, when installed, can not cause water leakage through the deck of the vessel.

Another object of the invention is to provide a rope cleat whose base, when installed, makes firm contact with the vessel deck.

Another object of the invention is to provide a rope cleat that can more easily withstand the lateral forces encountered when a rope pulls on a cleat.

Another object of the invention is to provide a means to secure other items to a deck such as fill caps, antenna mounts and the like that are installed in a similar manner to a cleat and posses similar leakage problems.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed cleat with gasket comprising: a horizontally disposed elongate bar, a plurality of vertically disposed support members, the upper portion of said support members integrally attached to the underside of said elongate bar, the mid portion of each said support member including a horizontally disposed plate, said plate having a recess on its underside, each said support plate including a centrally and downwardly disposed threaded post, said recessed portion capable of removably retaining a resilient gasket, said gasket including a centrally located aperture that allows said stud to penetrate said gasket.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
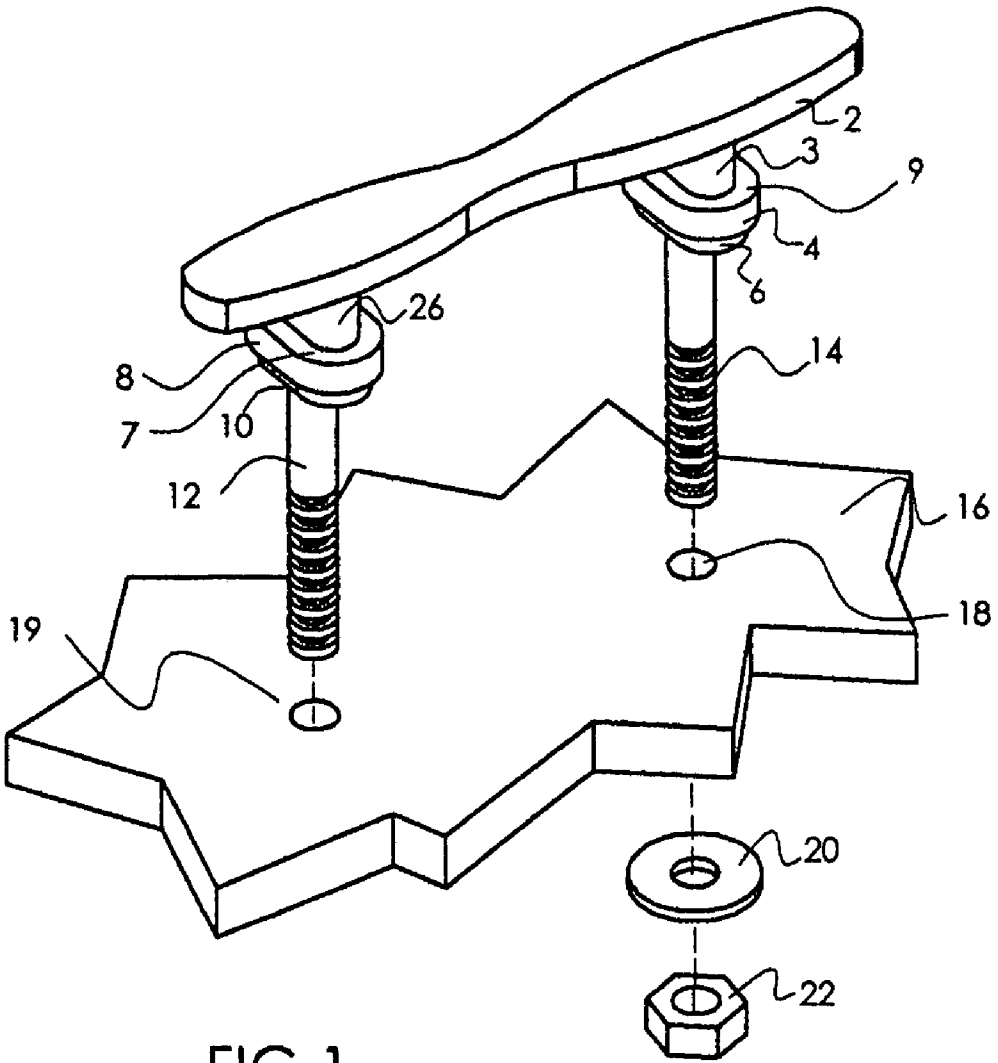
FIG. 1 is an exploded perspective view of the invention.
Figure 2:
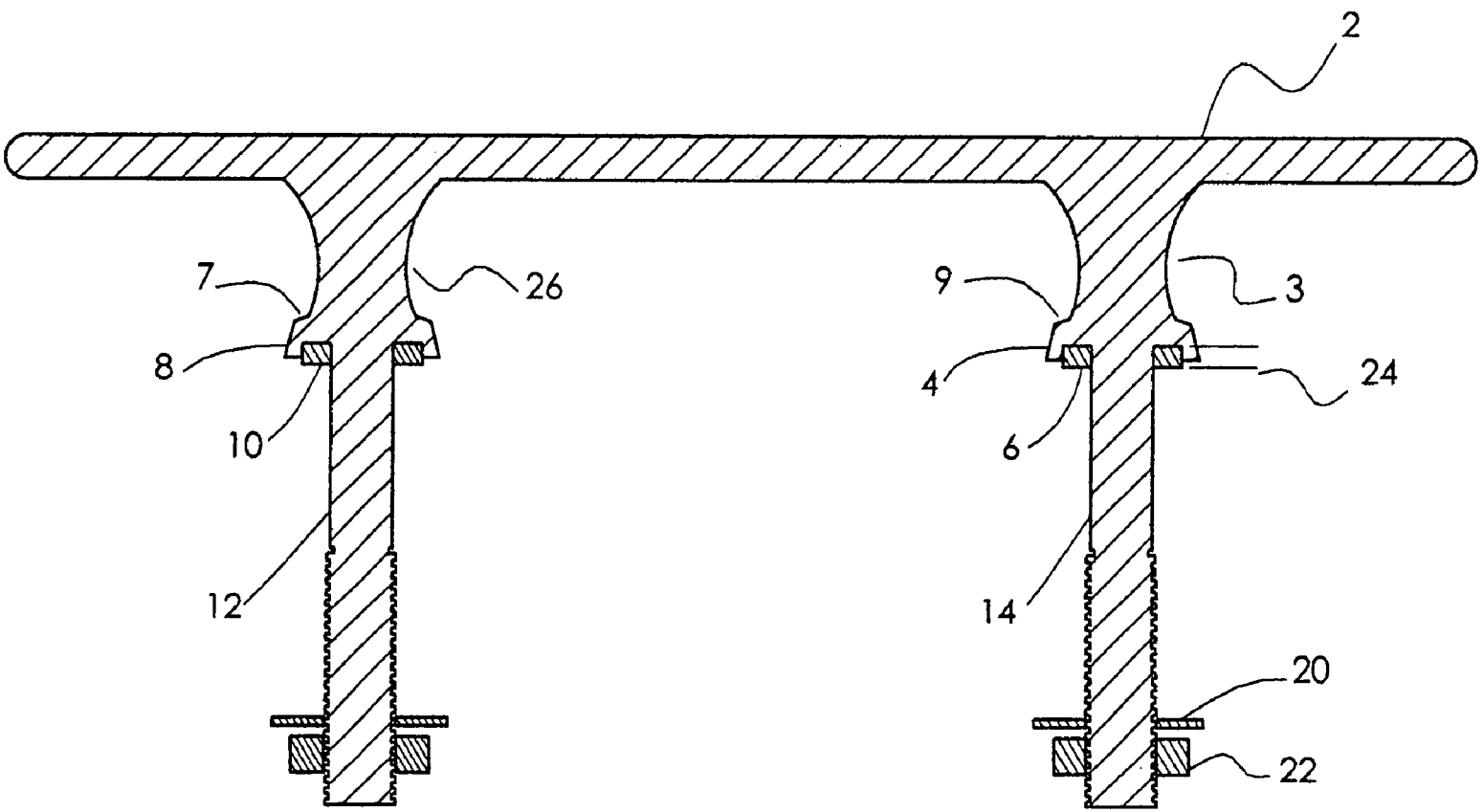
FIG. 2 is a side section view of the invention.
Figure 3:
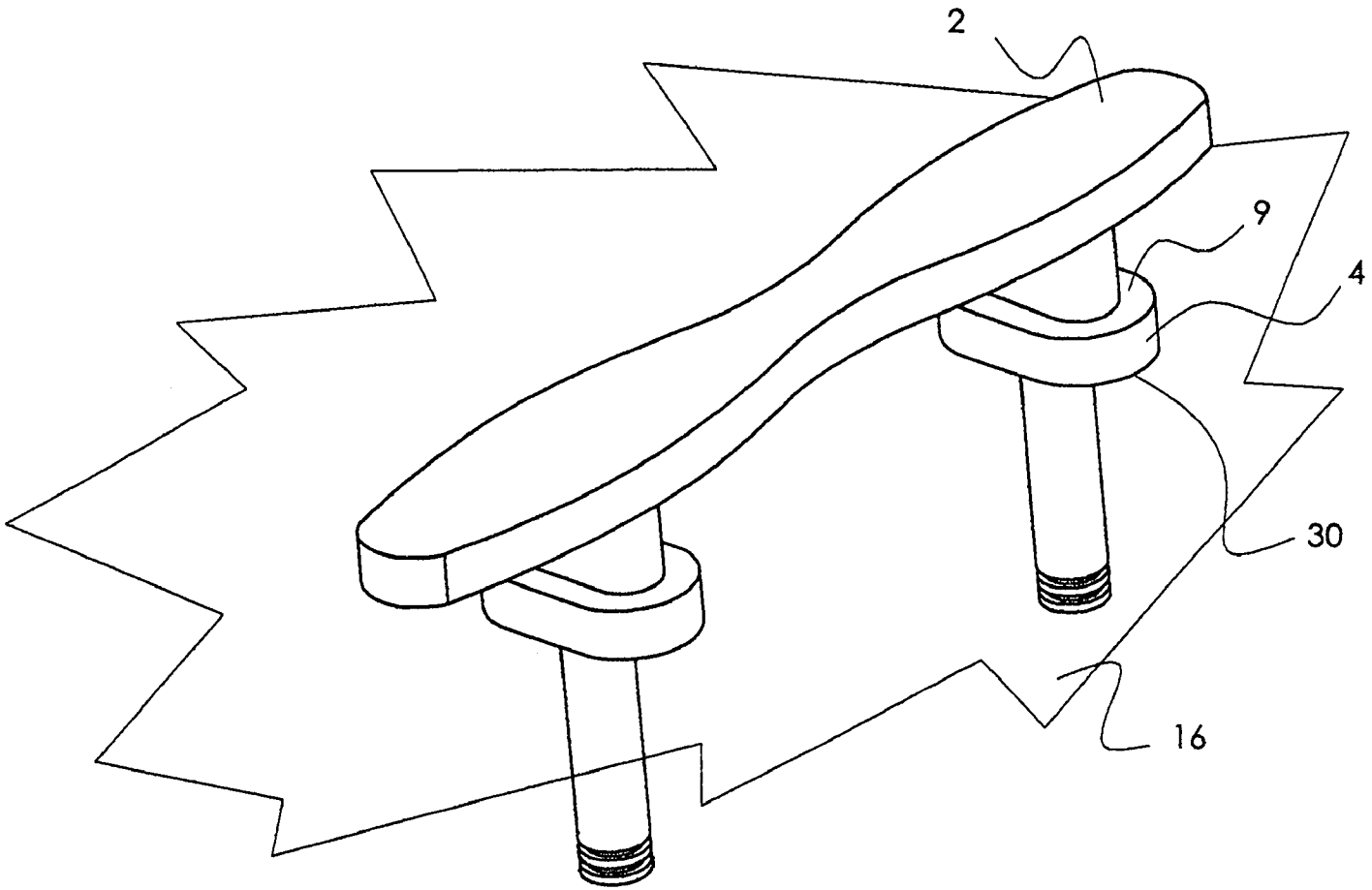
FIG. 3 is a perspective view of the invention in place on a deck.
Figure 4:
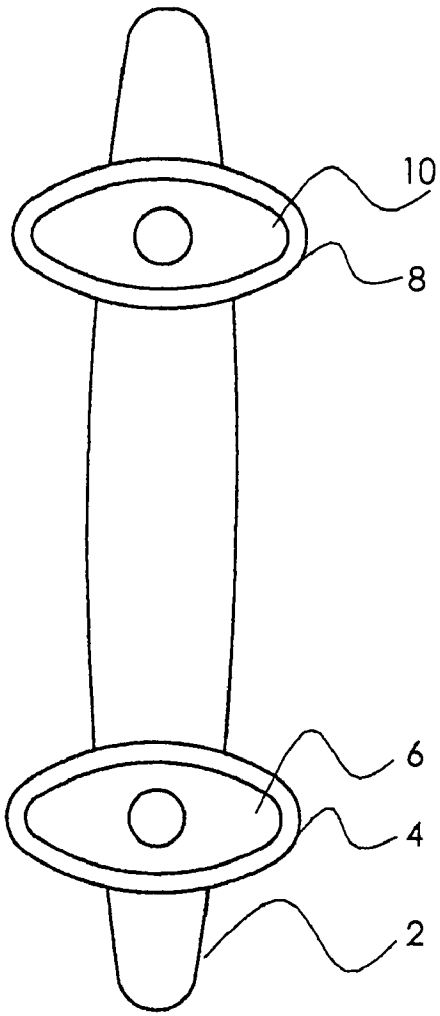
FIG. 4 is a bottom view of the invention.
Figure 5:
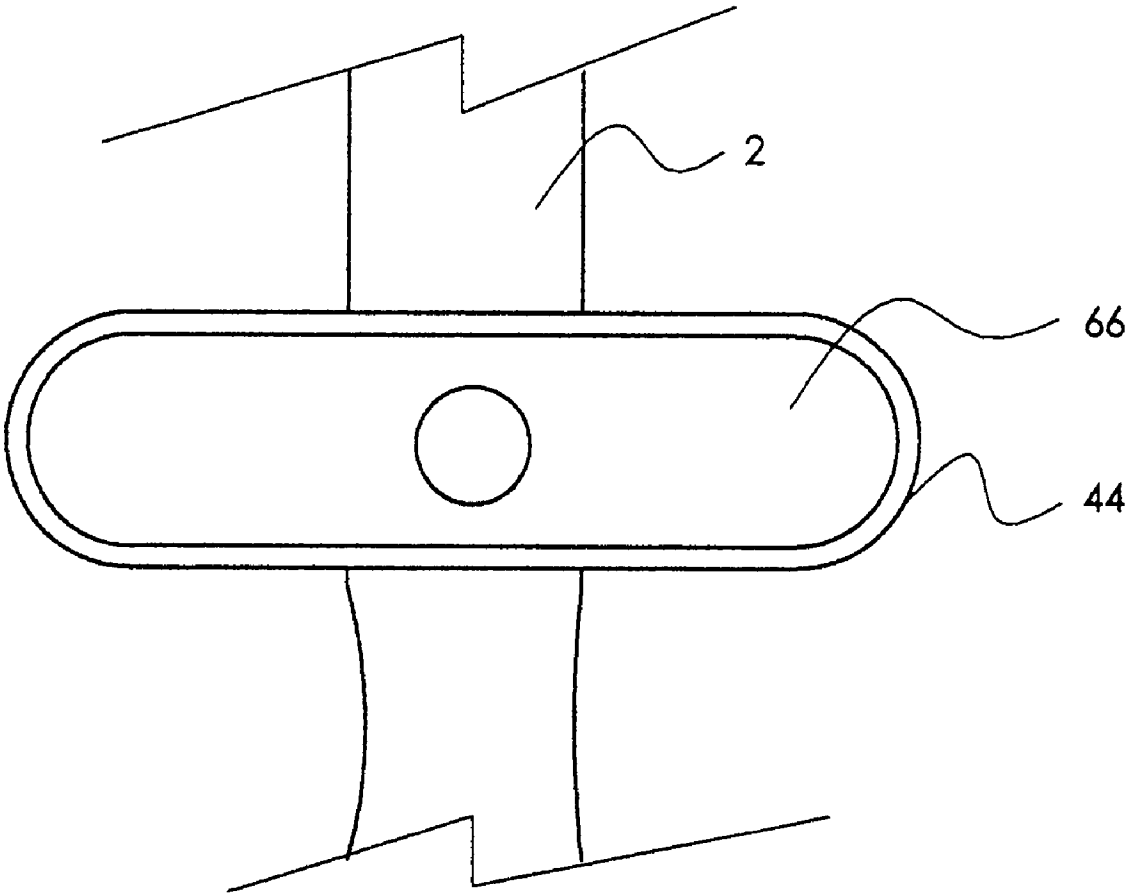
FIG. 5 is a partial bottom view of an alternate embodiment of the invention.

Referring now to FIG. 1 we see an exploded view of the cleat present invention. The cleat is comprised of a horizontally disposed elongate rigid bar 2 and a plurality of integral support posts 3, 26 that include a horizontally disposed plate 7,9. From the underside of plate 7,9 protrudes a threaded post 12, 14. The threaded posts 12, 14 can penetrate apertures 18, 19 and be retained by a standard nut 22 and washer 20. FIG. 2 shows a side section view where the recessed gasket 6, 10 are retained by a skirt-like perimeter caused by recessed portion 4, 8 in the underside of horizontal plate 7, 9. The gasket 6, 10 is made of resilient PVC or neoprene, other flexible, compressible material such as rubber, silicone or the like. The gasket 6, 10 protrudes about twenty-five percent from the underside of skirt 4, 8 as shown by dimension lines 24 representing approximately twenty-five percent of the total thickness of the gasket 6, 10. When the cleat assembly of the present invention is installed on a deck 16 or the like as shown in FIG. 3, the gasket is compressed in a controlled way because when nut 22 and associated washer 20 are tightened, the perimeter skirt 4, 8 is forced down to the top surface of the deck thereby completely surrounding and retaining the gasket 6, 10 trapped inside. The gasket is compressed in a controlled manner providing both displacement and compression limits both laterally and vertically. This provides a controlled X/Y axis compression which is not affected by the over tightening of nut 22. This configuration increases the sealing effectiveness on the mounting bolts laterally and the cleat to deck seal vertically. Compression remains static in the gasket irrespectivbe of the cleat loads. Because the gasket compression does not vary and is protected from the outside elements in this configuration, the gasket will retain its integrity for an extended period of time. FIG. 3 shows a perspective view of the cleat of the present invention as it is installed on a standard deck 16. This view clearly shows that there is no excessive gap 30 between the bottom of the perimeter skirt 4, 8 and the deck 16. The finished installation of the cleat provides a non-flexing, hard surface to surface stable mounting. The containment ability of the skirt-like perimeter 4, 8 provides stability of the cleat base to the deck with controlled gasket compression regardless of cleat loads associated with mooring a boat and the like. This non-movement of the cleat base reduces flex loads on the mounting bolts and eliminates spike compression loads that could fatigue and distort the gasket causing water leaks through the deck. FIG. 4 shows a bottom view of the present invention. This view shows that horizontal plate 7, 9 and gasket 6, 10 are laterally displaced so that they extend further out on either side of the cleat than the area that is in alignment with the cleat bar 2. This design is ideal because of the lateral forces that are associated with the use of the cleat in conjunction with retaining ropes to a nearby dock. This view also shows the perimeter edge 8, 4. This is the portion that maintains intimate association with the deck when the cleat is tightened into place. FIG. 5 shows a partial bottom view of an alternate embodiment of the present invention where the perimeter portion 44 and retained gasket 66 are extended laterally even further to create even more lateral strength when the cleat is in use.

Figure 6:
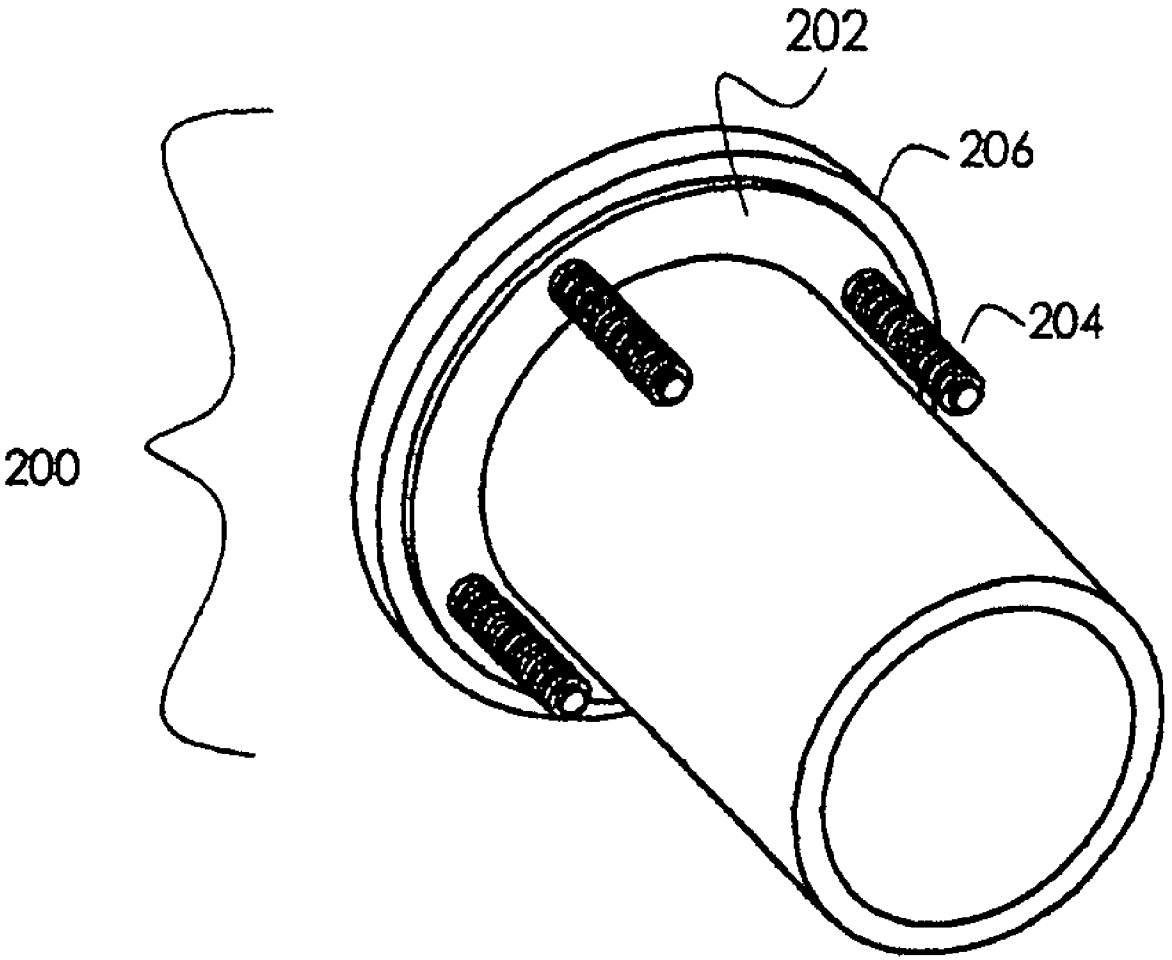
FIG. 6 is a perspective view of the bottom of a fill cap assembly
Figure 7:
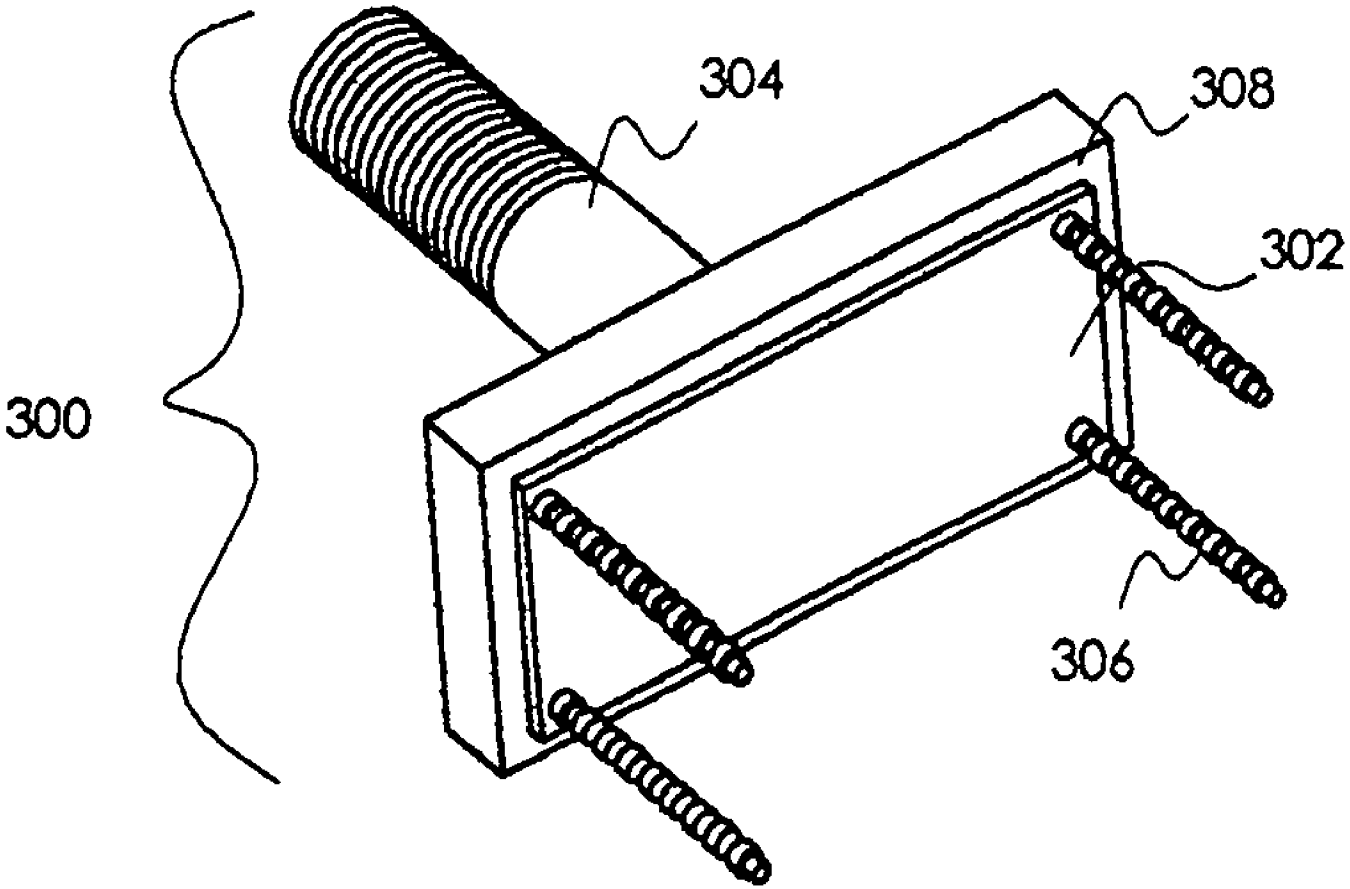
FIG. 7 is a perspective view of the bottom of an antenna mount assembly

FIG. 6 shows a bottom view of a standard cap fill assembly 200 that is commonly used for such applications as water fill caps, gas fill caps and waste removal caps that are mounted to the deck of a boat. These devices have the same problem that cleats have in that they include a plurality of bolts 204 that penetrate a boat deck and can be the cause of leakage. Therefore a similar concept of a recessed gasket 202 that is retained within the recessed perimeter 206 of cap assembly 200 can have the same effect as shown in the cleat design already described. FIG. 7 shows a bottom view of a standard antenna mount 300. These devices also have the possibility of leakage when designed and mounted in the conventional fashion. Therefore, a similar design to the cleat mounting system already described can also apply to the antenna mount 300. In this case gasket 302 is retained within the recess located in the bottom of base plate 308 so that when bolt portions 306 are put through apertures in the deck of a boat, the gasket 302 compresses in the same fashion as the cleat design described above.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. Cleat with gasket comprising:

a horizontally disposed elongate bar;

a plurality of integral, vertically disposed support members;

the upper portion of said support members integrally attached to the underside of said elongate bar;

the mid portion of each said support member terminating at its lower end in a horizontally disposed flat plate;

said flat plate having a recessed portion on its underside and a resulting skirt-like perimeter portion;

said recessed portion having a centrally and downwardly disposed threaded shaft;

said recessed portion capable of removably retaining a resilient gasket;

and said resilient gasket having a centrally disposed aperture capable of receiving said threaded shaft.

2. Cleat with gasket as claimed in claim 1 wherein said threaded portions of said vertical support members can penetrate apertures in a vessel deck so that said cleat can be secured to said deck by tightening standard threaded nuts.

3. Cleat with gasket as claimed in claim 1 wherein when said cleat is fastened to said deck said resilient gasket compresses so that the bottom skirt-like perimeter of said flat plate comes into intimate contact with said deck.

4. Cleat with gasket as claimed in claim 1 wherein said gasket is made of flexible PVC or neoprene or other resilient material.

5. Cleat with gasket as claimed in claim 1 wherein said skirt controls and maintains the ideal degree of compression exerted on said gasket both laterally and vertically.

6. Cleat with gasket as claimed in claim 1 wherein said perimeter skirt on the underside of said flat plate helps to protect said gasket from abrasion and exposure to sun and other elements and helps maintain controlled compression and displacement limits of said gasket.

7. Cleat with gasket as claimed in claim 1 wherein the bottom of perimeter skirt of said flat plate extends laterally on each side of said support member in a perpendicular orientation to increase the stability of said cleat when lateral forces are exerted on it during use.

* * * * *